United States Patent [19]

Stillwell

[11] 4,445,698

[45] May 1, 1984

[54] ROLLER SKATE WITH USER POWERED DRIVE MECHANISM

[76] Inventor: James R. Stillwell, 3069 W. 16th Ave., Vancouver, British Columbia, Canada

[21] Appl. No.: 337,111

[22] Filed: Jan. 5, 1982

[51] Int. Cl.[3] ..... A63C 17/12

[52] U.S. Cl. ..... 280/11.115

[58] Field of Search ..... 280/11.115, 11.19, 11.21, 280/221, 226 R, 226 A, 251, 205; 272/70, 70.3

[56] References Cited

U.S. PATENT DOCUMENTS 619,370 2/1899 Wagner ..... 280/11.115
684,260 10/1901 Jassmann ..... 280/11.115
1,566,380 12/1925 Dennison ..... 280/226 R
1,628,004 5/1927 Stetson ..... 280/11.115

*Primary Examiner*—David M. Mitchell
*Attorney, Agent, or Firm*—Carver & Company

[57] ABSTRACT

Skate adapted to derive motive power from the body weight of the user. The frame has vertical racks cooperating with gears on the foot support for maintaining the foot support in a generally horizontal position during vertical reciprocating movement thereof. Forward movement of the skate is achieved by a flexible tension link cooperating with the gears and a driving wheel via a pawl and ratchet combination and a recoil arrangement.

5 Claims, 3 Drawing Figures

ROLLER SKATE WITH USER POWERED DRIVE MECHANISM

BACKGROUND OF THE INVENTION

1. Field of the Invention

The invention relates to a skate adapted to derive motive power from the body weight of the user imposed thereon.

2. Prior Art

U.S. Pat. No. 619,370 to Wagner discloses a roller skate, in which the foot support is connected to the driving wheel by means of a flexible tension link and a ratchet and pawl combination in order to convert reciprocating vertical movement of the foot support into forward motion of the skate. The foot support is suspended by four suspension bars extending through the bottom plate of the frame of the skate. Four coil springs are arranged concentrically with the suspension bars and between the foot support and the bottom plate in order to restore the foot support to its upward position after the downward stroke. With this arrangement, there is increased friction between the suspension bars and the bottom plate, if the foot is tilted front to rear or sideways. Furthermore, the downward stroke is limited by the ground clearance of the suspension bar extending below the bottom plate of the frame.

U.S. Pat. No. 1,924,948 to Lieberenz discloses a skate, wherein a lazy tong structure forms the connection between the foot support and the frame. A rack connected to the center pivot of the lazy tong structure and extending below the bottom part of the frame during the downward stroke drives a pinion, which in turn cooperates with a sprocket and chain drive for propelling the skate. This arrangement also necessitates ground engaging wheels of relatively large diameter to provide adequate ground clearance.

Skates according to French Patent Specification No. 2,441,398 to Buran and U.S. Pat. No. 2,449,871 to Bohler employ driving arms spreading apart during the downward stroke to propel the skates. The connection of the foot support to these arms is such, that the foot support cannot easily be maintained in a pre-determined, stable, generally horizontal position during its vertical reciprocating movement.

SUMMARY OF THE INVENTION

It is an object of the invention to provide a skate, in which the foot support is reliably maintained in a predetermined support position during the vertical reciprocating movement thereof.

It is a further object of the invention to arrange the foot supporting means and the driving means in such a manner, that improved ground clearance of the skate is achieved, so that ground engaging wheels of small diameter can be used. Thus, the feet of the user are as close to the ground as possible in order to give the user improved balance.

A skate according to the invention has a frame with axles and ground engaging wheels thereon, at least one of the wheels being a driving wheel, and a foot support adapted to hold one of the user's feet. A pair of front racks and a pair of rear racks are provided, the racks of a pair being vertically connected to the frame and spaced apart transversely from the longitudinal axis of the frame. A pair of front gears are rigidly connected to a front shaft, and a pair of rear gears are rigidly connected to a rear shaft, the front and rear shafts being rotatably connected to the foot support, and the front and rear gears being adapted to mesh with the front and rear racks respectively. Intermediate gears are rotatably connected to the foot support and adapted to mesh with the front and rear gears so that the foot support is maintained in a pre-determined support position and the front and rear gears are rotating in an opposite direction during vertical reciprocating movement of the foot support. Driving means are cooperating with the gears and each driven wheel. Restoring means are provided for returning the foot support to its upward position after release of the downward pressure of the foot.

A detailed description following, related to drawings, gives exemplification of structure according to the present invention which, however, can be expressed by means other than those particularly described and illustrated.

DETAILED DISCLOSURE

Figure 1:
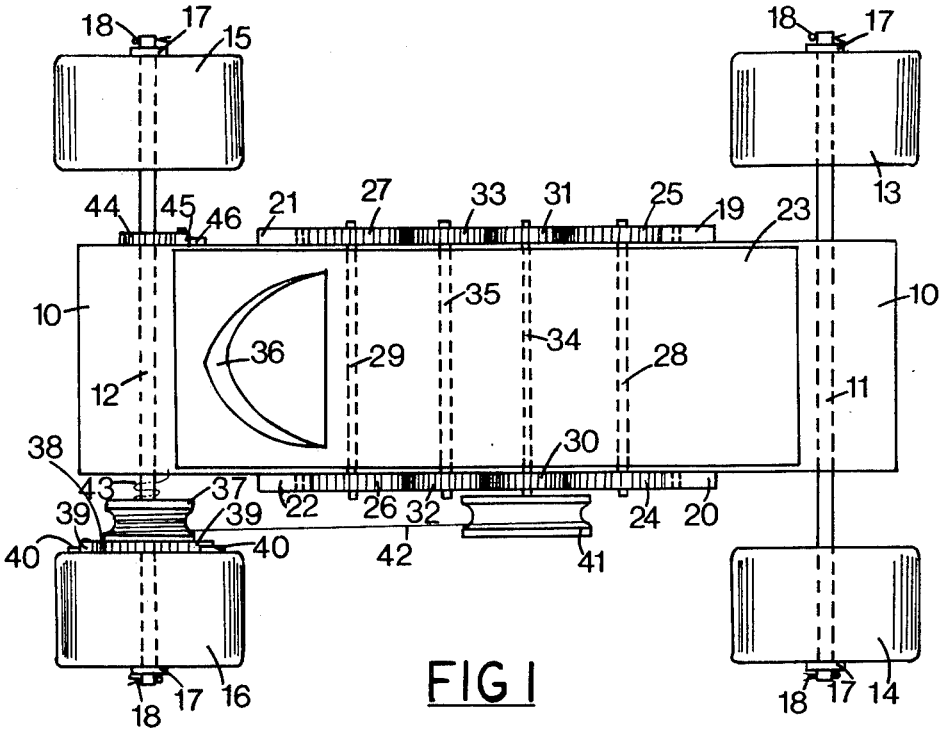
FIG. 1 is a simplified top plan view of a skate according to the invention.
Figure 2:
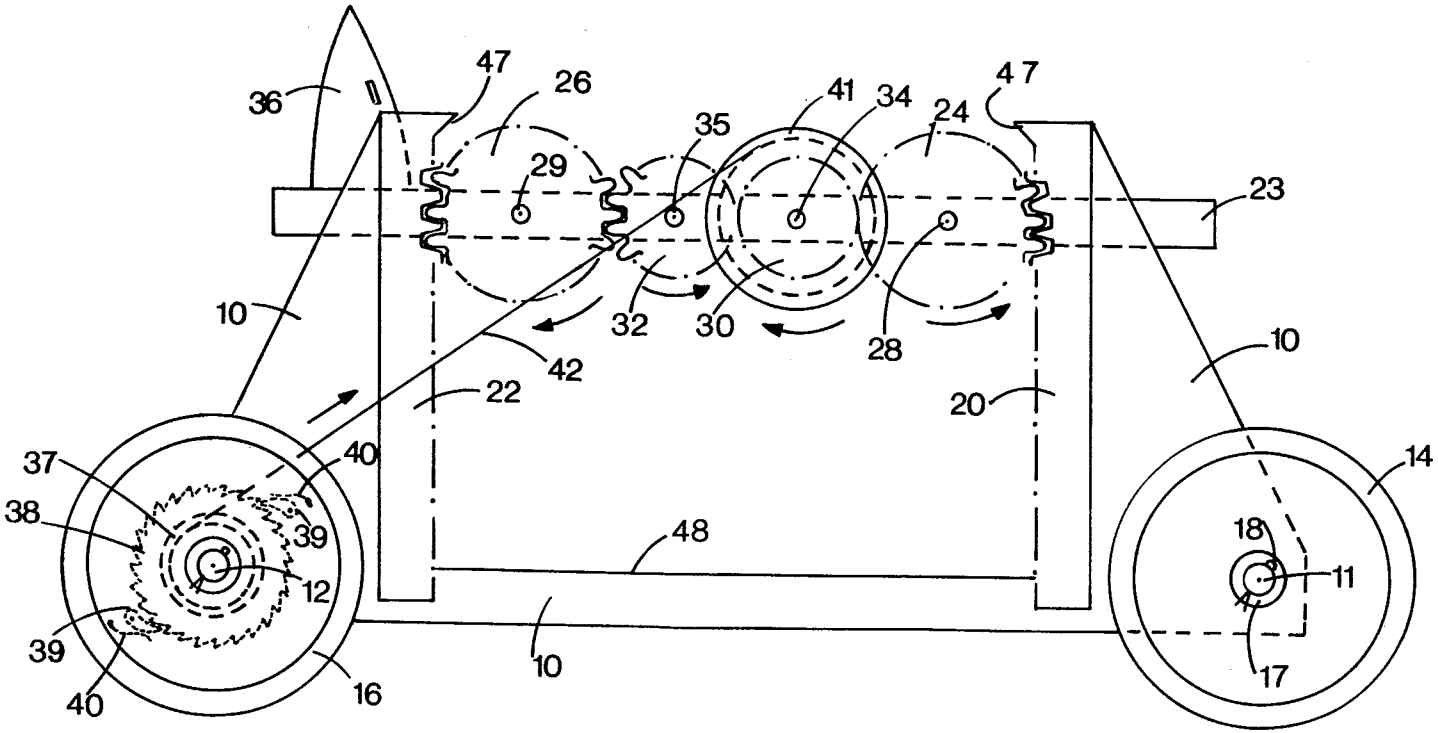
FIG. 2 is a simplified side elevation of the skate shown in FIG. 1.

In FIGS. 1 and 2, the skate according to the invention has a frame 10 with a front wheel axle 11 and a rear wheel axle 12 connected thereto. Ground engaging front wheels 13, 14 and rear wheels 15, 16 are connected to the wheel axles with washers 17 and cotter pins 18. Rear wheels 15 and 16 are rigidly connected to rear wheel axle 12, e.g. by keys (not shown). The front wheels 13 and 14 are free to rotate on the front wheel axle 11. A pair of front racks 19 and 20 and a pair of rear racks 21 and 22 are vertically connected to the frame 10.

A foot support 23 is interposed between racks 19, 20, 21 and 22. Front gears 24 and 25 and rear gears 26 and 27 are rigidly connected to a front shaft 28 and a rear shaft 29 respectively. The front and rear shafts are rotatably connected to the foot support. Intermediate gears 30, 31, 32 and 33 are connected to intermediate shafts 34 and 35 respectively. The intermediate shafts are also rotatably connected to the foot support. The intermediate gears are meshing with their corresponding front gears and rear gears. The foot support carries a heel piece 36. Fastening straps for the foot are provided, but not shown.

A first driving spool 37 is rigidly connected to a first ratchet wheel 38. This driving spool and ratchet wheel combination is rotatably connected to the rear wheel axle 12 adjacent the rear wheel 16. A first spring-loaded pawl arrangement, including pawls 39 and loading springs 40, are connected to rear wheel 16. A second driving spool 41 is rigidly connected to the intermediate gear 30. A flexible tension link, e.g. a rope 42 engages the driving spools 37 and 41, and each end of the rope is rigidly connected to one spool. A recoil spring 43 is connected between frame 10 and driving spool 37.

Figure 3:
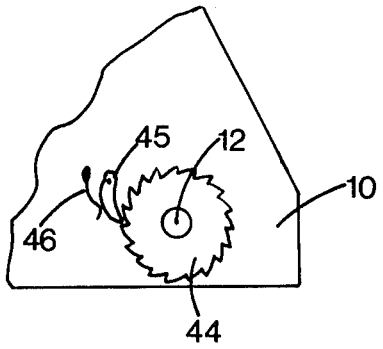
FIG. 3 is a simplified partial view showing a mechanism for preventing backward movement of the skate.

In FIG. 3 an end portion of the frame 10 is shown broken away with the rear wheel 15 pulled off the rear wheel axle 12. A second ratchet wheel 44 is rigidly connected to the rear wheel axle 12 adjacent frame 10 and a second pawl 45 loaded by a spring 46 is connected to the frame.

Stop faces 47 are provided on the upper ends of the racks 19, 20, 21 and 22 and at 48 on the bottom part of frame 10 for limiting the stroke of the foot support 23.

OPERATION

Without weight on it, the foot support 23 is in its uppermost position limited by the stop faces 47 on the upper ends of the racks 19, 20, 21 and 22. When the user shifts his body weight to the skate under discussion, the foot support moves downward, while the gears 24, 26, 30 and 32 are rotating between the racks 20 and 22 as indicated by arrows in FIG. 2. The gears 25, 27, 31 and 33 rotate in the same sense, because they are rigidly interconnected by the shafts 28, 29, 34 and 35. Consequently, the foot support maintains its pre-determined, generally horizontal support position during the vertical movement thereof. No sideways or fore and aft tilting of the foot support is possible. It should be understood that the intermediate gears 30, 31, 32 and 33 need not necessarily be rigidly interconnected by the intermediate shaft 34 and 35, because they are forced to rotate in the desired manner by the front gears 24, 25 and the rear gears 26, 27.

During the downward movement, the driving spool 41 winds up the rope 42 delivered by the driving spool 37, which during its rotation, takes along the ratchet wheel 38. The pawls 39 lock onto the ratchet wheel 38 by action of the loading springs 40, thereby driving the rear wheels 15 and 16 forward until the foot support meets the stop faces 48 on the bottom part of the frame 10. Simultaneously, the recoil spring 43 is wound up. As long as the weight of the user remains on the foot support in the downward position, the rear wheels 15 and 16 can idle forward, while the pawls 39 unlock.

When the weight of the user is transferred to the other skate, the driving spool 37 winds up the rope 42 under the unwinding force of the recoil spring 43. This pulling action effective on the driving spool 41 turns all gears on the foot support in the reverse direction to that indicated in FIG. 2, whereby the foot support is raised to its uppermost position ready for starting a new operating cycle. Any backward movement of the skate is prevented by the pawl 45 locking onto the ratchet wheel 44 under the action of the spring 46.

As the whole gear mechanism remains essentially above the bottom part of the frame during operation, the ground clearance of the skate is good, so that ground engaging wheels of relatively small diameter can be used. This is desirable for a better balance of the user.

I claim:

1. A skate adapted to derive motive power from the body weight of the user imposed thereon, comprising:

(a) a frame having axles and ground engaging wheels thereon, at least one of the wheels being a driving wheel, (b) a foot support, adapted to hold one of the user's feet, (c) a pair of front racks and a pair of rear racks, the racks of a pair being vertically connected to the frame and spaced apart transversely from the longitudinal axis of the frame, (d) a pair of front gears rigidly connected to a front shaft, and a pair of rear gears rigidly connected to a rear shaft, the front and rear shafts being rotatably connected to the foot support, and the front and rear gears being adapted to mesh with the front and rear racks respectively, (e) intermediate gears rotatably connected to the foot support and adapted to mesh with the front and rear gears so that the foot support is maintained in a pre-determined support position and the front and rear gears are rotating in an opposite direction during vertical reciprocating movement of the foot support, (f) driving means cooperating with the gears and each driven wheel, (g) restoring means for returning the foot support to its upward position after release of the downward pressure of the foot.

2. A skate as claimed in claim 1, wherein the driving means comprises:

(a) a first driving spool and a first ratchet wheel combination rigidly connected together, the combination being freely rotatably connected to one wheel axle, (b) a first spring-loaded pawl arrangement connected to a driving wheel and engaging the first ratchet wheel in force transmitting manner only during the downward movement of the foot support, (c) a second driving spool connected to one of the gears, (d) a flexible tension driving link winding onto the second driving spool during the downward movement of the foot support and rewinding onto the first driving spool under the action of the restoring means.

3. A skate as claimed in claim 2, wherein the restoring means is a recoil spring connected between the frame and the first driving spool.

4. A skate as claimed in claim 2, further comprising a second ratchet wheel rigidly connected to one wheel axle and a second spring-loaded pawl connected to the frame and locking the second ratchet wheel when the skate is starting to move backwards, in order to prevent such reverse movement.

5. A skate as claimed in claim 1, wherein the front racks and the rear racks are spaced apart transversely from the longitudinal axis of the frame to provide clearance space, and the foot support is interposed in the clearance space.

* * * * *